US005083927A

United States Patent [19]

Herard et al.

[11] Patent Number: 5,083,927

[45] Date of Patent: Jan. 28, 1992

[54] SOLDERLESS COMPLIANT SOCKET

[75] Inventors: James D. Herard, Endicott; Steven R. Herard, Owego, both of N.Y.

[73] Assignee: International Business Machines Corporation, Armonk, N.Y.

[21] Appl. No.: 637,246

[22] Filed: Jan. 3, 1991

[51] Int. Cl.[5] ..... H01R 13/00

[52] U.S. Cl. ..... 439/80; 439/851

[58] Field of Search ..... 439/80-82, 439/84, 851-854, 856, 857, 861, 862

[56] References Cited

U.S. PATENT DOCUMENTS

| | | | |
|---|---|---|---|
| 3,010,093 | 11/1961 | Berg . | |
| 3,048,812 | 8/1962 | Heidler . | |
| 3,208,028 | 9/1965 | Mittler et al. . | |
| 3,218,606 | 11/1965 | Schultz | 439/82 |
| 3,504,328 | 3/1970 | Olsson . | |
| 3,792,412 | 2/1974 | Madden | 439/82 |
| 3,975,077 | 8/1976 | Peterson . | |
| 4,585,295 | 4/1986 | Ackerman . | |
| 4,657,336 | 4/1987 | Johnson et al. . | |
| 4,750,897 | 6/1988 | Neidecker . | |
| 4,878,851 | 11/1989 | Mullen, III | 439/81 |

OTHER PUBLICATIONS

Mill-Max Manufacturing Corp., Oyster Bay, N.Y.—Literature—3 pages.

Augat, Inc., Attleboro, Massachusetts—describing the "Holtite" contact.

IBM Technical Disclosure Bulletin, vol. 30, No. 6, 11/87, p. 292—"Zero Insertion Force Connector with Beam Inserted into Tube and Moved Laterally to Contact Tube at Inside Wall and Rim".

IBM Technical Disclosure Bulletin, vol. 18, No. 11, 4/76, p. 3588—Solderless Module-To-Circuit Connection.

*Primary Examiner*—Joseph H. McGlynn

*Attorney, Agent, or Firm*—Lawrence R. Fraley

[57] ABSTRACT

A socket for use within a circuit board's conductive opening, e.g., plated-thru-hole, to frictionally engage the opening's internal surface(s) and thereby retain the socket within the opening without the need for solder or the like material. The socket includes a first plurality, e.g., three, of resilient members to achieve said frictional engagement with the opening's surface(s) and a second plurality of resilient members to frictionally engage a conductive pin which is inserted within the socket to thereby become electrically connected thereto. The force exerted by the resilient members against the opening's internal surface(s) exceeds that exerted by the other resilient members against the conductive pin to thereby assure retention of the socket during pin insertion and withdrawal. A connector assembly using such a socket is also defined herein. The socket is preferably of tubular metallic material, e.g., beryllium-copper.

20 Claims, 4 Drawing Sheets

SOLDERLESS COMPLIANT SOCKET

TECHNICAL FIELD

This invention relates to electrical sockets and particularly to such sockets which may be used in substrates such as printed circuit boards or the like to receive a conductive member, e.g., pin, therein.

CROSS REFERENCE TO COPENDING APPLICATION

In Ser. No. (S.N.) 07/507,434, filed Apr. 11, 1990 and entitled "Electrical Connector of the Pin and Socket Type", there is defined a connector assembly which includes a first connector with a pin-like extension which is adapted for being inserted within a second connector having a socket to form an electrical connection. The socket includes a double bend therein so as to deflect and thereby provide at least three points of contact between the socket and pin.

BACKGROUND OF THE INVENTION

Electrical sockets of the above type are known in the art, with examples being shown in U.S. Pat. Nos. 3,208,028 (Mittler et al), 3,218,606 (Schultz), 3,504,328 (Olsson), 3,792,412 (Madden), 4,585,295 (Ackerman) and 4,657,336 (Johnson et al). Typically, such sockets require solder to assure retention thereof within the circuit board and/or to provide the desired electrical connection to the inserted pin, are of relatively elongated configuration (to also assure positive retention thereof within the board opening as well as to effectively engage the conductive pin), and/or are of relatively complex shape which in turn permits positioning thereof within the board opening in only a singular direction (from one side of the board only).

As defined herein, the socket of the instant invention is designed for being frictionally inserted within a circuit board opening and thus retained therein without the need for solder or the like material, is of a compact configuration such that it fits substantially entirely within the opening (between the opposed outer surfaces of the board) and is thus adapted for electrically engaging an inserted pin substantially entirely within said opening, and, because of its unique configuration, is readily capable of being inserted within the board opening from either side of the board in a facile manner.

It is believed that a socket including the above highly advantageous features, among others discernible from the following definition, will constitute a significant advancement in the art. It is also believed that an electrical connector assembly including such a socket as part thereof would also constitute a significant advancement in the art.

DISCLOSURE OF THE INVENTION

It is, therefore, a primary object of the instant invention to enhance the art of electrical connectors which utilize electrical sockets as elements thereof.

It is another object of the invention to provide an electrical socket which is of compact design, is capable of being positively retained within a circuit board opening without the use of solder or the like material, and which can be readily positioned within such an opening in a facile manner.

It is yet another object of the invention to provide a socket as defined above which can be produced on a relatively large scale and thus at relatively lesser costs in comparison to typical socket constructions of the prior art.

It is a still further object of the invention to provide an electrical connector assembly which utilizes sockets of the type defined herein and the several advantages thereof.

In accordance with one aspect of the invention, there is provided a socket for being positioned within a circuit board's conductive opening wherein the socket comprises a first plurality of substantially curvilinear resilient members adapted for engaging a surface of the opening with a first, predetermined frictional force and a second plurality of substantially curvilinear resilient members adapted for engaging a conductive pin inserted within the socket with a second, predetermined frictional force less than the first frictional force (so as to effectively retain the socket within the board opening while simultaneously assuring positive contact and removal, if desired, of the inserted pin).

In accordance with another aspect of the invention, there is defined a connector assembly which comprises a circuit board, a conductive pin inserted within a conductive opening within the board, and a socket located within the board's opening and including first and second pluralities of substantially curvilinear, resilient members. The first plurality (e.g., three) is designed for positively engaging the opening's surface with a first frictional force while the second plurality is designed for positively engaging the conductive pin with a second frictional force less than that force (the first) for engaging the board opening.

BEST MODE FOR CARRYING OUT THE INVENTION

For a better understanding of the present invention, together with other and further objects, advantages, and capabilities thereof, reference is made to the following disclosure and appended claims in connection with the above-described drawings.

Figure 2:
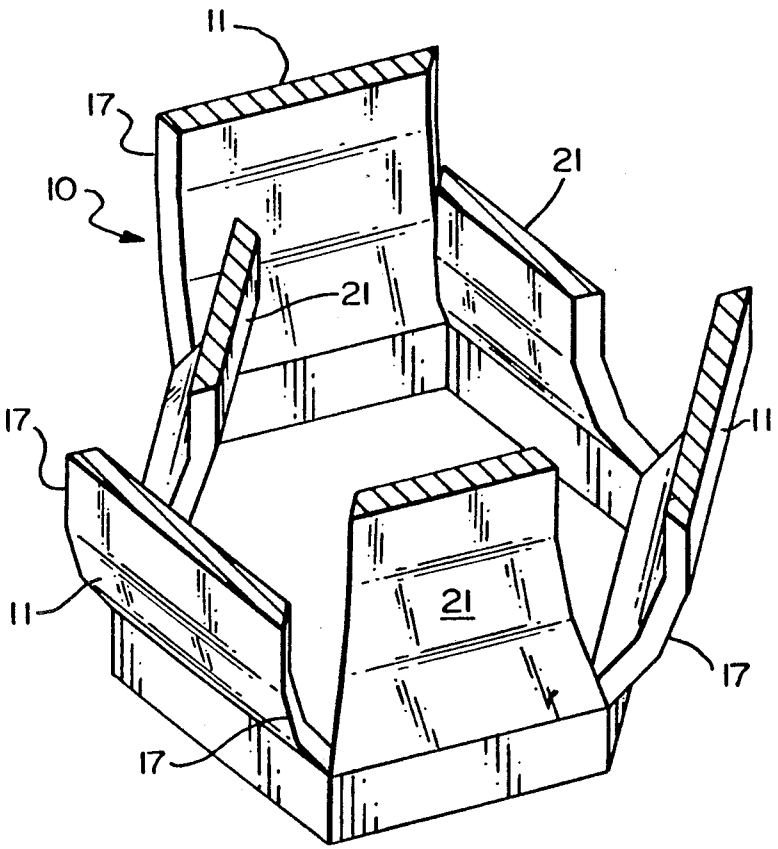
FIG. 2 is a partial perspective view of the socket of FIG. 1, illustrating portions of the resilient members of the socket and the respective positioning thereof.
Figure 1:
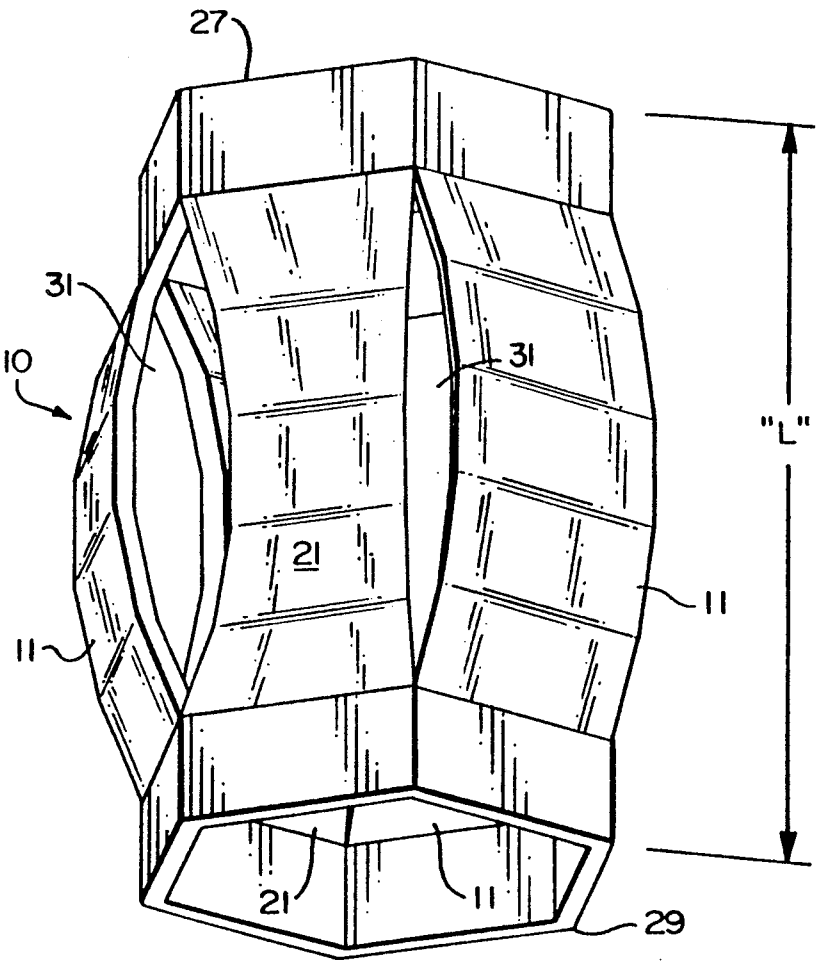
FIG. 1 is a perspective view, on a much enlarged scale, of a socket in accordance with a preferred embodiment of the invention.

In FIGS. 1 and 2, there is shown a socket 10 in accordance with a preferred embodiment of the invention. Socket 10 is only partially shown in FIG. 2 for illustration purposes. As defined herein, socket 10 is particularly adapted for being positioned within a conductive opening, e.g., plated-through-hole, located within a circuit board. Such conductive openings are known in the art and are formed, typically, within a circuit board member to provide electrical connection with various electrical components, as well as internal and/or external circuitry which forms part of the board structure. Such openings are typically plated with a suitable conductive material, e.g., copper, and, in some embodiments, extend through the entire thickness of the board structure. In some more recent circuit board structures, as many as about 20,000 such conductive openings may be provided within the board material. Because such openings are known in the art, further description is not believed necessary. It is understood, however, that socket 10 is not limited to utilization within a conductive opening which extends through the entire thickness of the board structure. That is, it is understood from the description herein that socket 10 may be inserted within a partial conductive opening which extends only partly within the circuit board. Such partial openings are also known in the art and further description is thus not believed necessary.

Socket 10, as shown in FIG. 1, includes a first plurality of substantially curvilinear resilient members 11 which are adapted for engaging the internal surface(s) 13 (FIG. 3) of a conductive opening 15 of the type defined above. In a preferred embodiment, three such resilient members 11 are used, each adapted for slidably engaging in a frictional manner the internal surface(s) 13 in the manner shown. Attention is also directed to FIGS. 5 and 6 wherein this engagement is further shown.

Figure 6:
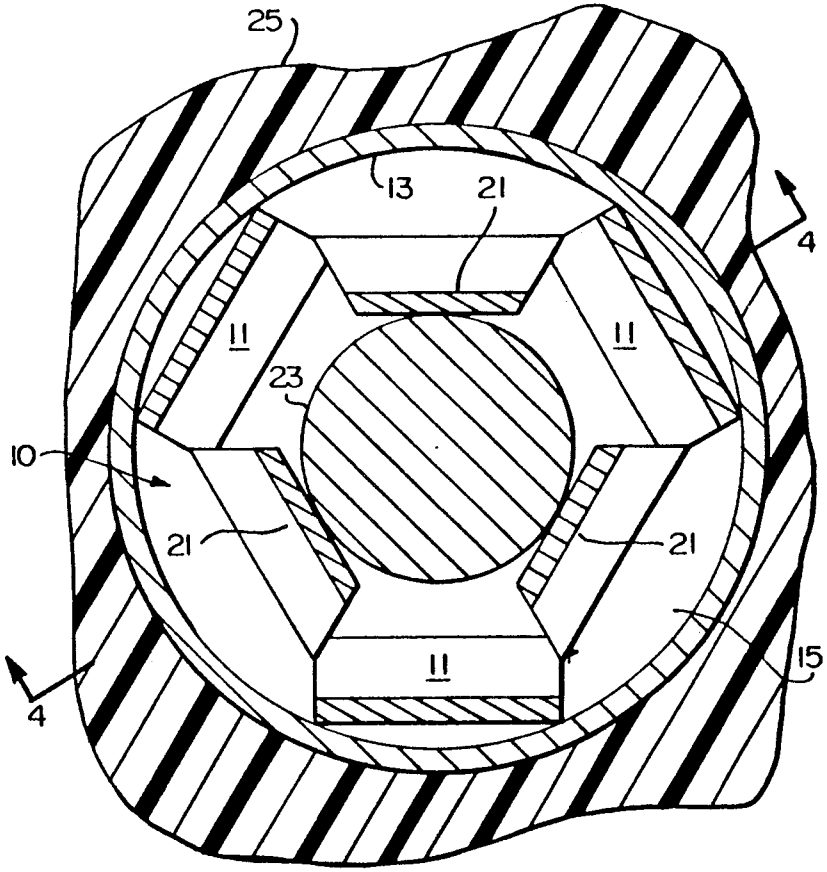
FIG. 6 is a partial view, in section, as taken along the line 6—6 in FIG. 4, illustrating the invention with a conductive pin fully positioned therein.
Figure 5:
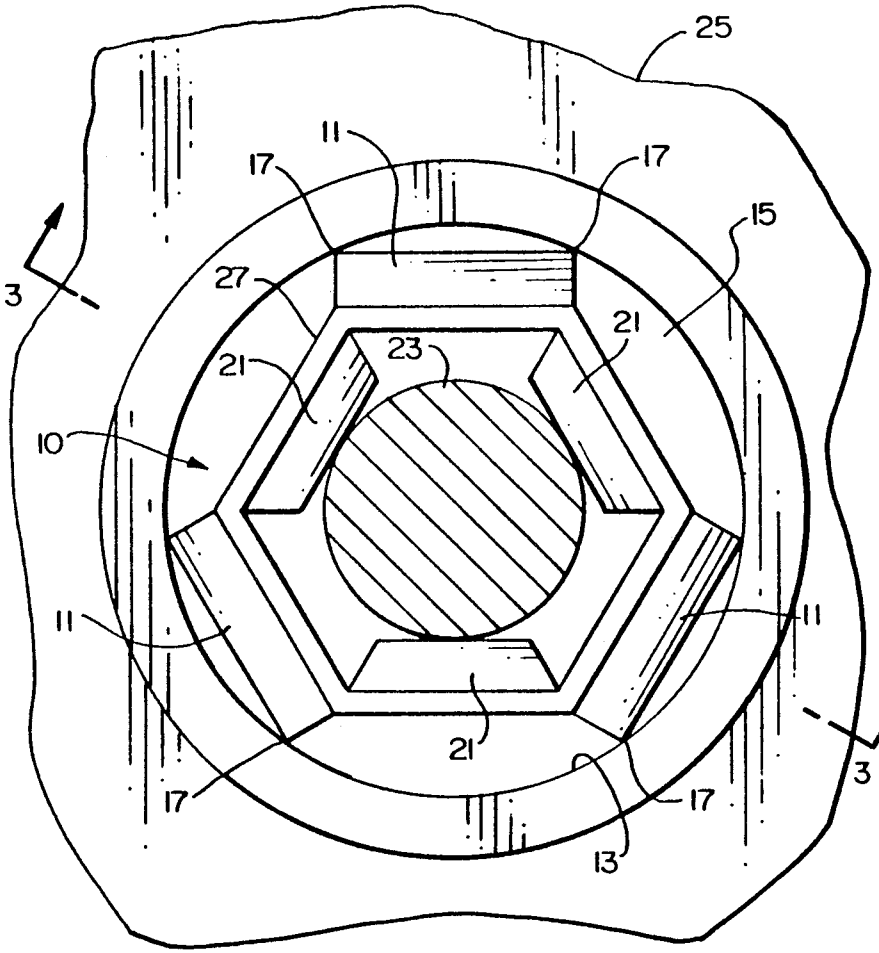
FIG. 5 is a partial plan view, as taken along the line 5—5 in FIG. 3, illustrating the upper surface of a circuit board and the conductive opening therein, said opening including the socket of FIG. 1 therein and a conductive pin located relative to the socket.

Socket 10 is preferably of tubular metallic material which is a sound conductor, a preferred example being beryllium-copper. Other materials, including copper alloys, are also readily usable for socket 10. In one embodiment of the invention, socket 10 may possess an overall length (dimension "L" in FIG. 1) of about 3.30 millimeters (mm). Each of the resilient, curvilinear members 11 which form part of socket 10 preferably has a thickness within the range of from about 0.05 mm to about 0.10 mm. In the fully expanded, non-engaging (free state) orientation as depicted in FIGS. 1 and 2, socket 10, as defined by the outermost curved surfaces of members 11, may possess an overall external diameter of about 1.30 mm. This dimension is thus slightly larger than the internal diameter for the cylindrical conductive opening 15, which, in one embodiment of the invention, may be about 1.19 millimeters (mm). As best shown in FIGS. 5 and 6, each of the curvilinear, substantially flat resilient members 11 serve to engage the internal surface(s) 13 of opening 15 along the outer edges 17 of each member. Such edge engagement by a plurality of three such resilient members thus assures engagement by at least six such edges at predetermined, spaced locations about the opening's inner periphery. Such engagement thus serves to substantially retain the socket in position and also provide centering thereof to receive an inserted conductive pin (described below).

Thus, the outer edges of each resilient member 11 engage the internal surface(s) 13 of opening 15 with a predetermined, first frictional force, which, in one embodiment of the invention, is preferably within the range of about 1.5 to about 2.0 newtons per resilient member. Such a force is deemed sufficient to positively retain the socket at the positions indicated in FIGS. 3-6.

As further seen in FIGS. 1 and 2, socket 10 further includes a second plurality of substantially curvilinear resilient members 21 which, as shown, are of substantially similar curvilinear shape as the alternating, outwardly extending resilient members 11, but are inwardly extending. Members 21, preferably three in number, are adapted for positively engaging an inserted conductive pin 23 (FIGS. 3-6) with a second, predetermined frictional force sufficient to assure positive electrical connection thereto. This second frictional force, in one embodiment, is preferably within the range of from about 0.50 to about 1.00 newtons, and thus somewhat less than the aforedefined first frictional force used to positively retain socket 10 in position within the opening 15. This is considered a significant aspect of the invention because it assures effective positioning of socket within a circuit board 25 without the utilization of solder or the like, while also assuring effective contact with an incoming conductive pin such as pin 23 and also, significantly, enabling removal of said pin without dislocation of socket 10. Such effective retention is also attained without substantial deformation (e.g., scoring) of the conductive opening's internal surfaces. By the term pin as used herein is meant to include cylindrical metallic elements as shown herein, as well as other shaped geometries (e.g., rectangular, hexagonal, octagonal, etc.). Such a term is also meant to include multistranded wire structures.

In one embodiment of the invention, pin 23 is preferably of copper or the like material and may possess an outer diameter of about 0.305 mm. In such an embodiment, each of the inwardly extending resilient members 21 form tangents defining an internal cylindrical opening of a diameter of about 0.228 mm, thus slightly less than the aforedefined external pin diameter to thereby assure a positive frictional engagement between these members. Significantly, each of the inwardly extending curvilinear members 21 positively engages the pin at spaced locations (three when using three such members 21) to also assure centering of the pin relative to both socket and conductive opening. Of further significance, this type of engagement is what is referred to as a point type of contact wherein the contacting location on the curvilinear member 21 meets with a singular point on the also curvilinear conductive pin. Such a point type of engagement is assured because the axis of curvature of each member 21 is substantially perpendicular to the longitudinal axis LA—LA (FIG. 4) of opening 15 (and elongated pin 23). It is also understood from the embodiments of the invention as depicted in FIGS. 3-6, that the axis of curvature of each of the outwardly extending resilient members 11 is also substantially perpendicular to longitudinal axis LA—LA.

As shown in FIGS. 5 and 6 (and also partly in FIG. 2), the narrowest width for each of the inwardly projecting members 21 is preferably less than the corresponding uniform width for members 11. More preferably, these members (21) each possess a substantially hourglass configuration when viewed in elevation, in comparison to the remaining members (11), which are of uniform outer width when viewed in elevation.

In the embodiment of socket 10 as shown in the drawings, wherein three resilient members are used for each plurality for the purposes defined, it is preferred that each outwardly extending member 11 be positioned substantially opposite the corresponding inwardly projecting member 21, such that these members are located about the periphery of socket 10 in a substantially alternating relationship. It is also preferred that socket 10 be of integral construction so as to include opposing first and second closed (continuous) end portions 27 and 29, respectively, each closed end being of substantially hexagonal configuration and, significantly, of the aforedefined closed construction so as to assure effective positioning of the respective resilient members 11 and 21. That is, each of these resilient members extends from the respective side of each end in the manner depicted in the drawings, such that each resilient member is separated from the adjacent such member by a relatively narrow, elongated slot 31. Use of such end portions to commonly constrain all resilient members at each opposing end of the invention results, significantly, in an increased force necessary to deflect all such members (including both members 11 and 21) in comparison to non-constrained sockets, such as illustrated in the aforementioned art.

Although each of the defined plurality of resilient members includes three in the embodiment depicted herein, this is not meant to limit the invention in that as little as two such members may be used for each plurality. Greater than three members for each plurality may also be used.

Figure 3:
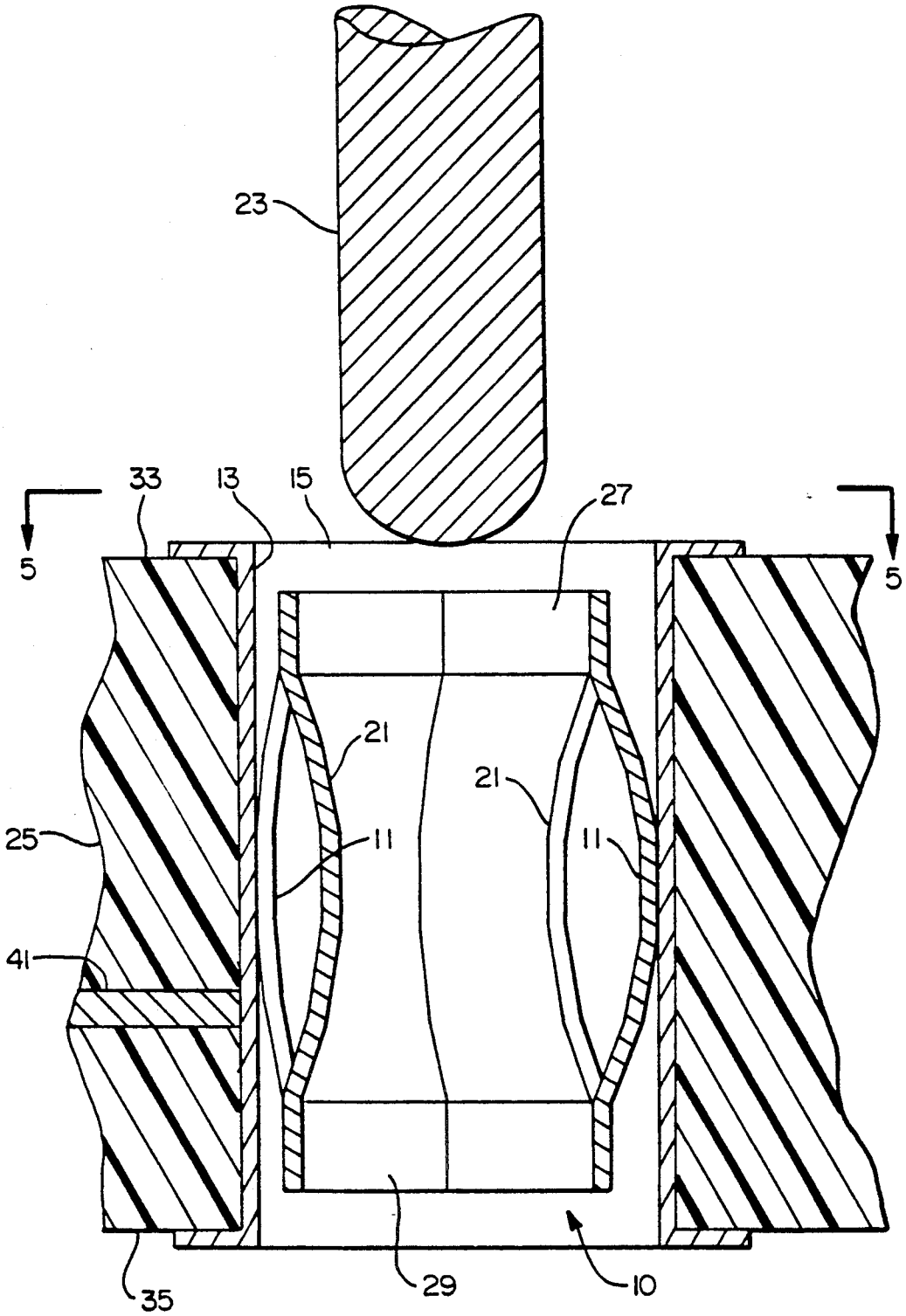
FIG. 3 is a side elevational view of the socket of FIG. 1, shown within a circuit board and about to have a conductive pin inserted therein, said view on a slightly reduced scale over the view in FIG. 1, said view also taken along the line 3—3 in FIG. 5.
Figure 4:
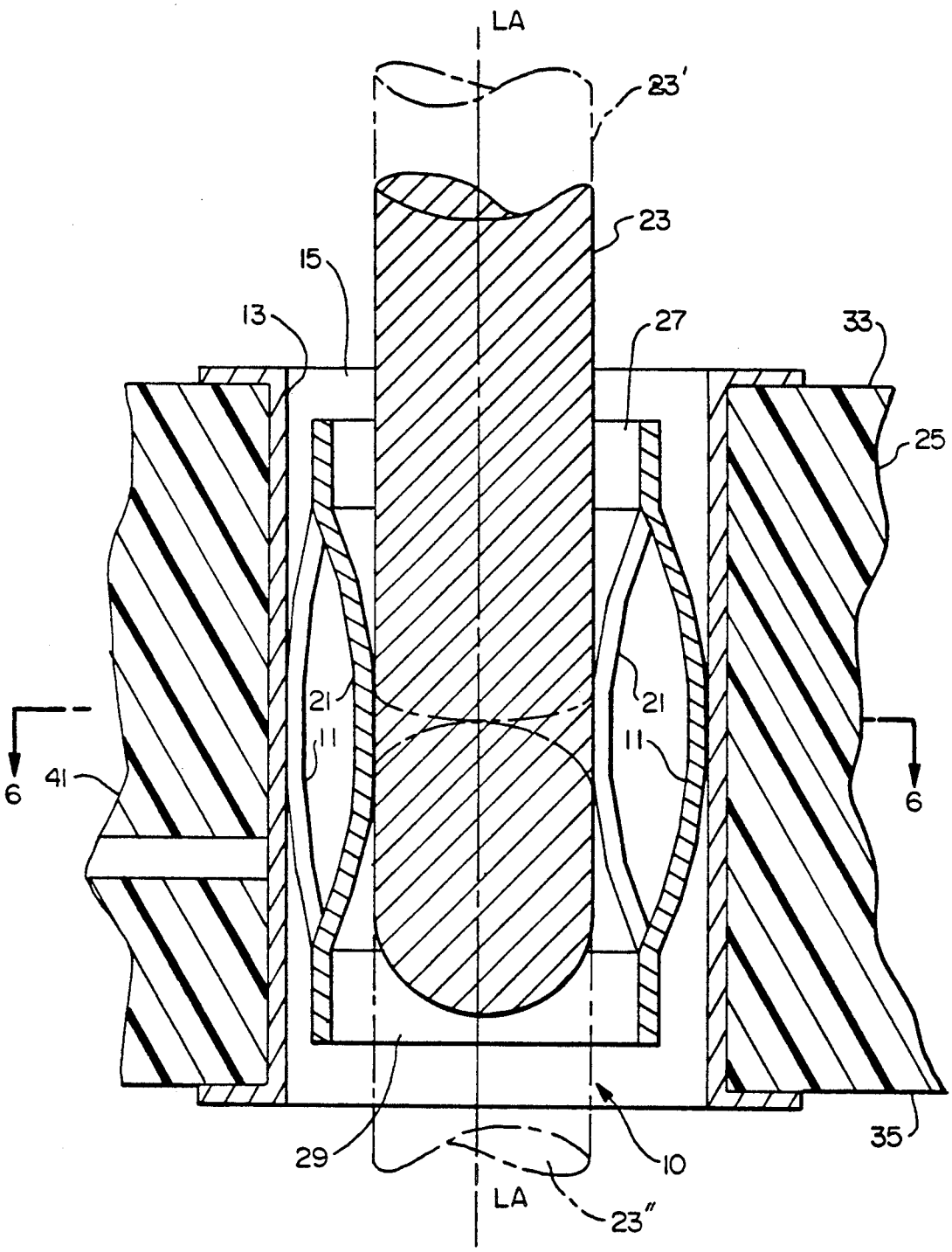
FIG. 4 is a side elevational view of the socket of FIG. 1, located within a circuit board opening and having a conductive pin inserted therein, said view also taken along the line 4—4 in FIG. 6.

Significantly, and as best seen in FIGS. 3 and 4, socket 10 is of relatively compact construction and thus is specifically designed for being positioned within conductive opening 15 so as to lie between the outer (upper and lower, in FIG. 3) surfaces 33 and 35, respectively. In one embodiment, board 25 may possess an overall thickness (distance between surfaces 33 and 35) of only about 3.60 mm. Thus, socket 10, having the aforementioned length "L", is readily capable of being positioned between these surfaces so as not to extend externally from board 25. This is considered a significant aspect of the invention because it assures positive connection with pin 23 between such surfaces, thereby allowing greater utilization of board real estate external of opening 15 for other purposes, e.g., positioning of additional electronic components. The above thickness for board 25 is not meant to limit the invention, in that other board structures may also be utilized. Circuit boards, including particularly those of the multilayered variety specifically adapted for utilizing the instant invention, are well known in the art and may include thicknesses within the range of from about 1.50 mm to about 7.60 mm. Typically, such boards may include at least one, and usually several, internal conductive, e.g., power, signal or ground, planes 41 therein, as well as having conductive circuitry located on an outer surface thereof (not shown). Thus, socket 10 serves to provide electrical connection between the internal conductive surfaces 13 of plated opening 15 and an inserted pin 23 such that pin 23 may be further connected to additional electrical structures, including planes 41. For circuit boards possessing substantial overall thicknesses (those at least twice the overall length ("L") for socket 10), it is possible to utilize two such sockets per conductive opening, preferably in an end-to-end orientation inserted from opposing sides of the board. Such an arrangement is also possible when receiving two pins within the board from opposing directions (see below).

Of further significance, socket 10, due to its integral construction, is readily capable of being inserted within opening 15 from either of the opposing sides of board 25. Regardless of which direction the socket is inserted, pin 23 may also be inserted through either of the opposed, substantially hexagonal apertures defined by opposing ends 27 and 29, thus even further promoting ease of assembly for these components.

In addition to the above, socket 10 enables insertion of two pins from opposing directions within the socket and effective connection thereto. This is also represented in FIG. 4 wherein an upper pin (shown in phantom and represented by the numeral 23') is shown partially inserted within socket 10 and in contact with the inwardly curved members 21. A second pin, also shown in phantom and represented by the numeral 23'', is shown as being inserted from an opposing direction (bottom) upwardly into socket 10 where it also is effectively engaged with members 21. The terminal ends of these two pins meet at the approximate mid-point of socket 10, as shown in FIG. 4. Thus, depending on the pin shape, socket 10 allows two opposing pins to be simultaneously positioned therein and effective contact made with such pins. It is understood, however, that in a preferred embodiment of the invention, socket 10 is particularly designed for accommodating a singular pin in order to assure the aforedefined point type of contact therewith.

Thus there has been shown and described a socket for use within a circuit board's conductive opening to positively engage both the opening and a conductive pin inserted therein with frictional force sufficient to retain the socket within the opening during such pin insertion and, if desired, withdrawal. Significantly, the socket is positioned within the plated opening without significant deformation thereof, such that repeated positionings of the socket, and replacements, if desired, within the opening are possible. The socket as defined herein is compatible with a variety of pin and opening configurations, although, as described, it is understood that preferably those of the substantially cylindrical shape are accommodated. The integral construction for this socket assures relatively low manufacturing costs to produce and assemble the socket. In addition to the above, there has been shown and described a connector assembly which includes a circuit board having at least one conductive opening therein, said opening including one of the sockets as defined above therein and a conductive pin inserted within the socket (and opening). The circuit board may be of multilayered construction of a type known in the art, while the preferred conductive opening is a plated-through-hole including a conductive layer, e.g., copper, as the conductive material. Such a board may include both internal and external circuit, power and/or ground planes as part thereof.

While there have been shown and described what are at present considered the preferred embodiments of the invention, it will be obvious to those skilled in the art that various changes and modifications may be made therein without departing from the scope of the invention as defined by the appended claims.

What is claimed is:

1. A socket for being positioned within a conductive opening having a longitudinal axis within a circuit board, said socket comprising:

a first plurality of substantially curvilinear resilient members adapted for engaging the surface of said conductive opening with a predetermined first frictional force sufficient to positively retain said socket within said conductive opening without the use of solder or the like material;

a second plurality of substantially curvilinear resilient members adapted for engaging a conductive pin inserted within said socket with a predetermined second frictional force less than said first frictional force, the axes of curvature of both said first and second pluralities of said substantially curvilinear resilient members being substantially perpendicular to said longitudinal axis of said conductive opening.

2. The socket according to claim 1 wherein the number of each of said first and second pluralities of members is three, said members being oriented within said socket in an alternating manner.

3. The socket according to claim 1 wherein said second plurality of members is adapted for engaging a second conductive pin inserted within said socket from an opposing direction of insertion of said other conductive pin.

4. The socket according to claim 1 wherein said circuit board includes a pair of opposed outer surfaces and said conductive opening is located substantially between said circuit board outer surfaces, said first plurality of curvilinear resilient members adapted for engaging said conductive opening between said circuit board outer surfaces.

5. The socket according to claim 4 wherein said second plurality of curvilinear resilient members is adapted for engaging said conductive pin between said opposed outer surfaces of said circuit board.

6. The invention according to claim 4 wherein said socket is adapted for being positioned within said conductive opening of said circuit board from the direction of either of said opposed outer surfaces.

7. The invention according to claim 1, wherein said socket is of integral construction including first and second opposing end portions, said first and second pluralities of resilient members interconnecting said opposing end portions.

8. The socket according to claim 7 wherein said first and second opposing end portions are each of substantially closed hexagonal configuration and include an aperture therein adapted for having said conductive pin pass therethrough.

9. The socket according to claim 1 wherein said first plurality of members each provide an edge type of connection with said surface of said conductive opening.

10. The socket according to claim 9 wherein said second plurality of members each provide a point type of connection with said conductive pin.

11. A connector assembly comprising:

a circuit board including at least one conductive opening therein, said opening having a longitudinal axis;

a conductive pin inserted within said conductive opening; and a socket positioned within said conductive opening and including a first plurality of substantially curvilinear resilient members engaging the surface of said conductive opening with a predetermined first frictional force sufficient to positively retain said socket within said opening without the use of solder or the like material and a second plurality of substantially curvilinear resilient members engaging said conductive pin with a predetermined second frictional force less than said first frictional force, the axes of curvature of both said first and second pluralities of said substantially curvilinear resilient members being substantially perpendicular to said longitudinal axis of said conductive opening.

12. The connector assembly according to claim 11 wherein the number of each of said first and second pluralities of members is three, said members being oriented within said socket in an alternating manner.

13. The connector assembly according to claim 11 further including a second conductive pin inserted within said socket from an opposing direction of insertion of said other conductive pin, said second plurality of members also engaging said second pin.

14. The connector assembly according to claim 11 wherein said circuit board includes a pair of opposed outer surfaces and said conductive opening is located substantially between said circuit board surfaces, said first plurality of curvilinear resilient members engaging said conductive opening between said circuit board surfaces.

15. The connector assembly according to claim 14 wherein said second plurality of curvilinear resilient members engages said conductive pin between said opposed outer surfaces of said circuit board.

16. The connector assembly according to claim 14 wherein said socket is adapted for being positioned within said conductive opening of said circuit board from the direction of either of said opposed outer surfaces.

17. The connector assembly according to claim 11 wherein said socket is of integral construction including first and second opposing end portions, said first and second pluralities of resilient members interconnecting said opposing end portions.

18. The connector assembly according to claim 17 wherein said first and second opposing end portions are each of substantially closed hexagonal configuration and include an aperture therein, said conductive pin passing through at least one of said apertures.

19. The connector assembly according to claim 11 wherein said first plurality of members each provide an edge type of connection with said surface of said conductive opening.

20. The connector assembly according to claim 19 wherein said second plurality of members each provide a point type of connection with said conductive pin.

* * * * *

UNITED STATES PATENT AND TRADEMARK OFFICE

CERTIFICATE OF CORRECTION

PATENT NO. : 5,083,927

DATED : 1/28/92

INVENTOR(S) : J. D. Herard et al

It is certified that error appears in the above—identified patent and that said Letters Patent is hereby corrected as shown below:

On the title page: 75 (Inventors) - delete Steven R. Herard and insert --Steven R. Shinners--.

Signed and Sealed this

Thirteenth Day of April, 1993

*Attest:*

STEPHEN G. KUNIN

*Attesting Officer*

*Acting Commissioner of Patents and Trademarks*